United States Patent [19]

Mori et al.

[11] Patent Number: 4,502,933

[45] Date of Patent: Mar. 5, 1985

[54] APPARATUS FOR ELECTROLYTIC TREATMENT TO METAL WEB

[75] Inventors: Teruo Mori; Hiroshi Shirai; Tsutomu Kakei; Tsuneyasu Matsuhisa; Masaru Watanabe, all of Shizuoka, Japan

[73] Assignee: Fuji Photo Film Co., Ltd., Kanagawa, Japan

[21] Appl. No.: 447,555

[22] Filed: Dec. 7, 1982

[30] Foreign Application Priority Data

Dec. 18, 1981 [JP] Japan ..... 56-204747

[51] Int. Cl.[3] ..... C25D 7/06

[52] U.S. Cl. ..... 204/206; 204/28; 204/269; 204/273

[58] Field of Search ..... 204/28, 206–211, 204/237, 268, 269, 273

[56] References Cited

U.S. PATENT DOCUMENTS

| | | | |
|---|---|---|---|
| 3,468,783 | 9/1969 | Avellone | 204/207 |
| 3,871,982 | 3/1975 | Idstein | 204/207 |
| 3,969,211 | 7/1976 | Watanabe | 204/211 |

*Primary Examiner*—G. L. Kaplan
*Assistant Examiner*—W. T. Leader
*Attorney, Agent, or Firm*—Sughrue, Mion, Zinn, Macpeak & Seas

[57] ABSTRACT

A method and apparatus for electrolytic treatment to a metal web includes transporting the metal web between pairs of electrolytic-plates which are immersed in an electrolyzer. A plurality of insulating members extends from upper surface or bottom of the electrolyzer along a widthwise direction of the metal web, and the insulating members function to interrupt a flow of the electrolyte which is circulated in the electrolyzer which increases the agitation rate of the electrolyte in the vicinity of the surfaces of the metal web.

1 Claim, 2 Drawing Figures

APPARATUS FOR ELECTROLYTIC TREATMENT TO METAL WEB

BACKGROUND OF THE INVENTION

1. Field of the Invention

The present invention relates to a method and apparatus for the electrolytic treatment of a metal web. Such electrolytic treatment of a metal web is suitable for various purposes, e.g. plating, electrolytic deposition, anodization, graining and cleaning.

2. Description of the Prior Art

In electrolytic treatment to a metal web on a mass production level, high productivity is required. Therefore, the electrolytic treatment to the metal web tends to be performed at rather high current densities. However, electrolytic treatment at such high current densities promotes the generation of bubbles which causes a non-uniform appearance on the surface of the metal web. Oftentimes uneven color shades appear on the surface of the metal web which indicates that the electrolyzed surface is non-uniform. Moreover, the electrolytic treatment at such high current densities requires the application of higher voltages which increases power consumption. Accordingly, it has been very difficult to accomplish high productivity at such high current densities. The problems identified above have been particularly troublesome when broad metal webs are electrolytically treated on both sides thereof. Thus, the elimination of the bubbles and the drawbacks associated therewith has long been desired.

The generation of bubbles inevitably occurs whenever the metal is electrolyzed. The attachment or adsorption of these bubbles to the surface of the metal, and sojourn or slowness of the movement of these bubbles causes abovementioned non-uniformity of electrolytic treatment on the metal surface. Thus, the electrolyte is required to be vigorously and effectively agitated to minimize the bad effects of the bubbles.

Heretofore, the agitation of the electrolyte has been accomplished by circulating it. FIG. 1 is a schematic sectional view of typical electrolyzer showing a prior art for continuously anodizing an aluminum web. Referring to FIG. 1, an aluminum web 1, is fed by rolls 4 into an first electrolyzer 2 filled with an electrolyte 3 through which electric current is supplied. The aluminum web 1 is carried while being immersed in the electrolyte 3. A plurality of anode plates or electrodes 5, connected to a positive electrode of an power source, are disposed so as to be opposed to the aluminum web 1. Therefore, the aluminum web 1 functions as a cathode during electrolysis in the first electrolyzer 2. The aluminum web 1 is then fed into the second electrolyzer 6. The second electrolyzer 6 and the second electrolyzer 2 are separated by partition plates 7. The second electrolyzer 6 is filled with an electrolyte 8. A plurality of cathode plates or electrodes 9 and 9', connected to a negative electrode of the power source, are disposed so as to be opposed to the aluminum web 1. Therefore, the aluminum web 1 functions as an anode in the second electrolyzer 6. The electrolysis results in the oxidation of the surface of the aluminum web 1, forming an oxide film thereon. During the above operation, the electrolytes 3 and 8 are withdrawn from the bath via suction pipes 10 and then returned to the electrolyzers 2 and 6 respectively via feed pipes 11 by means of pumps P. The electrolytes 3 and 8 are thus circulated and agitated thereby.

However, the stirring function by such an electrolyte circulation is limited and is insufficient to remove bubbles generated by electrolysis from the surface of the aluminum web 1. In addition, bubbles tend to stay longer on the bottom surface of the aluminum web 1 than on the upper surface thereof. Moreover, unlike the electrolyte covering the upper surface of the aluminum web 1, the electrolyte beneath the aluminum web 1 has no free surfaces and therefore tends to be stirred less efficiently than the electrolyte above the web 1 which has free uppermost surface. Accordingly, the lower surface of the aluminum web 1 tends to have a non-uniform anodized film deposited thereon, and the lower surface has a lower quality anodized film formed thereon as compared to the film formed on the upper surface.

In an attempt to eliminate the above disadvantage, the circulation speed of the electrolyte has been increased. Alternatively, the aluminum web has been transported through the electrolyzer in a vertical attitude.

However, increasing the circulation speed of the electrolyte requires a pump with a larger capacity which undesirably increases power consumption and requires extra piping and pump space. Moveover, the resulting increase in the flow rate of the electroyte sometimes generates additional bubbles due to cavitation and air caught by the electrolyte dropping down to the electrolyzer from the outlet port of the feed pipe, thus making it very difficult to eliminate the bubbles as desired. Furthermore, since the electrolyte is vigorously agitated only in the vicinity under the outlet port of the feed pipe, the agitation cannot be effective to a desirable extent using this method.

The second alternative is intended to eliminate the bad effects of the bubbles by transporting the aluminum plate vertically through the bath. However, this method is practically disadvantageous when applied to mass production because of technical difficulties in supplying electric power to the metal web and in maintenance of the apparatus required with this alternative method.

A third method, as disclosed in Japanese Patent Publication No. 21840/80 is to dispose electrical insulating partition plates on each side of the aluminum web so that the partition plates are parallel to one another and extend along a length of the aluminum web in the bath, with the partition plates also extending in a direction substantially perpendicular to the surfaces of the aluminum web. Hence, the partition plates define a channel so that the agitation created by the circulation of the electrolyte can be more effectively concentrated in that portion of the bath in the vicinity of the aluminum web. This method is intended to maximize the effect of the stirring caused by the electrolyte circulation by narrowing and limiting the region of circulation. However, the result is substantially the same as that created when a larger pumping system is utilized as proposed in the first method discussed above, and accordingly the partition plate method just described suffers substantially the same drawbacks as those identified for the first method discussed above.

SUMMARY OF THE INVENTION

Accordingly, an object of the present invention is to provide a method and apparatus for uniformly treating upper and lower surfaces of a metal web which is transported between pairs of electrodes immersed in an electrolyte. This object is achieved by disposing at least one insulating member in a bath containing the electrolyte so that the insulating member is disposed along a width-wise direction of the metal web and is spaced apart from one side of the metal web. Accordingly, the insulating member interrupts a flow of the electrolyte as the latter is circulated in the bath which increase an agitation rate of the electrolyte in the vicinity of the surface of the metal web. Preferably, a plurality of insulating members are disposed so as to extend from the upper and lower surfaces of the bath so that the agitation rate is increased on both surfaces of the metal web.

DESCRIPTION OF THE PREFERRED EMBODIMENT

Figure 1:
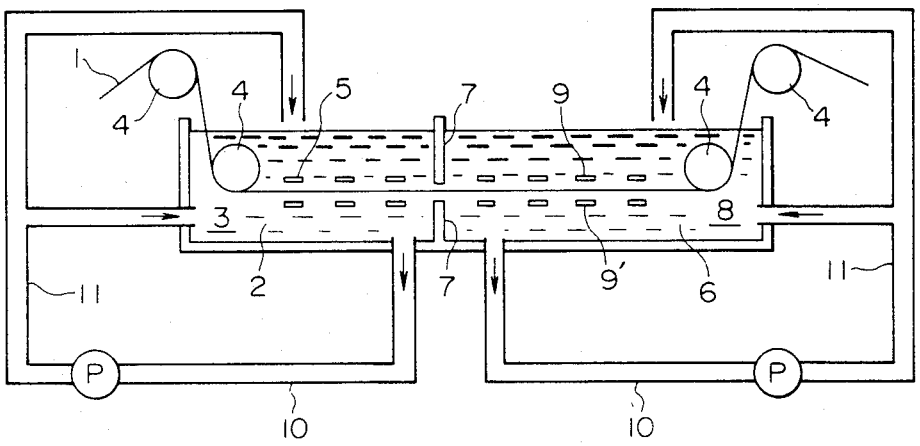
FIG. 1 PRIOR ART
FIG. 1 is a schematic sectional view of a prior art apparatus for anodizing an aluminum web.
Figure 2:
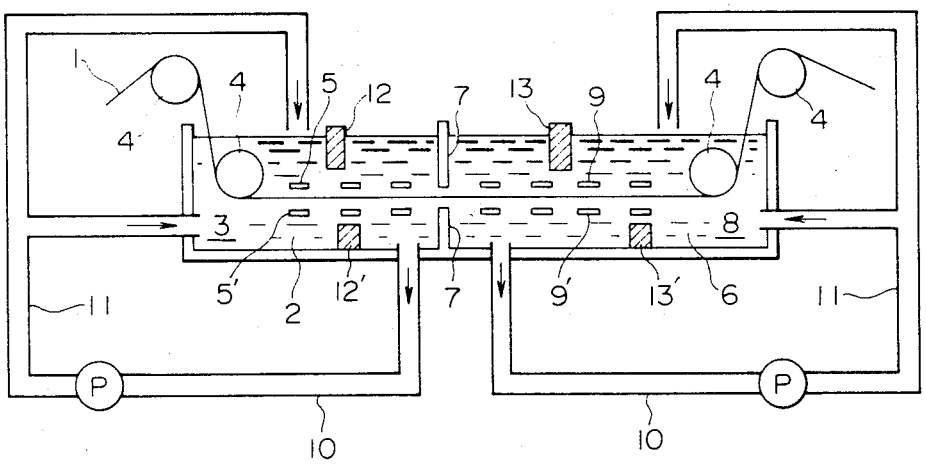
FIG. 2 is a schematic sectional view of an apparatus of the present invention for anodizing an aluminum web.

FIG. 2 is a schematic sectional view of an embodiment of the apparatus of the present invention for anodizing an aluminum web. For the purpose of simplification, like numerals are used for members corresponding to those listed in FIG. 1. Referring to FIG. 2, the first electrolyzer 2 and the second electrolyzer 6 are provided with electrical insulating members 12 and 12' and 13 and 13', respectively. These electrical insulating members extend along a width-wise direction of an aluminum web 1 and function to interrupt the circulation of electrolytes 3 and 8 in the electrolyzers 2 and 6, respectively. The electrical insulating members 12, 12', 13, 13' extend from upper surface of the bath and bottom of the electrolyzers 2, 6 respectively and terminate prior to reaching an area where the anode and cathode plates 5, 5', 9, 9' are disposed so that the electrolytes are vigorously agitated in the vicinity of the aluminum web surfaces. Accordingly, the attachment and residence of bubbles from electrolysis over the surface of the aluminum web is prevented, which results in uniformally anodized surfaces on the aluminum web.

In FIG. 2, the electrical insulating members are disposed over and under the aluminum plate in both electrolyzers. However, the object of this invention is also accomplished by an embodiment having electrical insulating members disposed either over or under the aluminum web in these electrolyzers. The electrical insulating members are preferably disposed so as to cover a part of the space between electrode plates 9 and 9'. That is, the electrical insulating members should be disposed at the distance of at least 5 mm from the aluminum web surface. Of course, the electrical insulating members may be disposed at other positions, as shown in FIG. 2. The electrical insulating members may be effectively disposed between the edges of the aluminum web. The electrical insulating members should be formed of materials which are not damaged by the electrolyte, e.g. plastic materials such as vinyl polychloride, FRP (glass Fiber-Reinforced Plastics) and ceramics. For easy handling, the electrical insulating members preferably should be formed into a plate or block shape. However, other shapes may be employed.

This invention is effective not only for the electrolytic treatment of both sides of the metal web as in FIG. 2 but also for the electrolytic treatment of one side of the metal web.

This invention is effective particularly for the electrolytic treatment of wide metal web and, more particularly, for the electrolytic treatment of metal web with a width of more than 300 mm, preferably 700 mm.

Although the above description has been referred to the anodization of an aluminum web, this invention may be effectively applied also to the electrolytic treatment to webs of other metals.

What is claimed is:

1. An apparatus for the electrolytic treatment of a metal web comprising first and second adjacent electrolyzers each adapted to be filled with a first and second electrolyte, respectively, and separated by an apertured partition, means for transporting a metal web through said first and second electrolyzers and said apertured partition along a horizontal path adapted to be immersed in said first and second electrolytes, a plurality of pairs of first electrodes located in said first electrolyzer on opposite sides of said horizontal path and a plurality of pairs of second electrodes located in said second electrolyzer on opposite sides of said horizontal path, a plurality of first and second insulating members located in said first and second electrolyzers, respectively, and extending transversely of said horizontal path above and below said first and second pairs of electrodes at a level adapted to be immersed within said first and second electrolytes with said insulating members below said electrodes contacting the bottom of said electroylzers and said insulating members above said electrodes adapted to at least be disposed in contact with the surface of said electroylytes, inlet and outlet means provided for each electrolyzer on opposite sides of said insulating members and means for circulating said first and second electrolytes through said respective inlet and outlet means past said insulating members for creating turbulence.

* * * * *